US006261014B1

(12) United States Patent
Altobellis et al.

(10) Patent No.: US 6,261,014 B1
(45) Date of Patent: Jul. 17, 2001

(54) APPARATUS FOR APPLYING A VISCOUS LOTION

(75) Inventors: Richard M. Altobellis; Douglas K. Ewald, both of Boulder; John L. Knight, Jr., Vail; David B. Shaffer, Lakewood, all of CO (US)

(73) Assignee: Sunglider, Inc., Denver, CO (US)

( * ) Notice: Subject to any disclaimer, the term of this patent is extended or adjusted under 35 U.S.C. 154(b) by 0 days.

(21) Appl. No.: 09/697,626

(22) Filed: Jan. 8, 2000

Related U.S. Application Data

(63) Continuation-in-part of application No. 09/444,046, filed on Nov. 19, 1999

(60) Provisional application No. 60/109,210, filed on Nov. 20, 1998.

(51) Int. Cl.[7] ..... B43M 11/06

(52) U.S. Cl. ..... 401/6; 15/104.94; 15/144.1; 401/261

(58) Field of Search ..... 401/6, 11, 12, 401/137, 261–267; 15/104.93, 104.94, 144.1; D28/7

(56) References Cited

U.S. PATENT DOCUMENTS

| | | | | |
|---|---|---|---|---|
| D. 306,214 | | 2/1990 | Delphus | D28/7 |
| D. 351,483 | * | 10/1994 | Angeletta | D28/7 |
| D. 384,437 | | 9/1997 | Helbock | D28/7 |
| 2,860,359 | | 11/1958 | James . | |
| 2,965,911 | | 12/1960 | Hempel et al. . | |
| 3,186,024 | | 6/1965 | McLemore . | |
| 3,214,781 | * | 11/1965 | Johnson et al. | 401/12 |
| 4,396,028 | * | 8/1983 | Waggoner | 401/6 X |
| 4,659,243 | | 4/1987 | Winson | 401/197 |
| 4,878,774 | * | 11/1989 | Karasin et al. | 401/267 X |
| 5,193,528 | * | 3/1993 | Iwamoto et al. | 601/72 |
| 5,269,037 | | 12/1993 | White . | |
| 5,566,418 | | 10/1996 | Steffen et al. | 15/244.1 |
| 5,904,151 | * | 5/1999 | Gueret | 401/266 X |
| 5,931,591 | * | 8/1999 | McCracken | 401/6 |
| 6,129,469 | * | 10/2000 | Messer et al. | 401/6 |

FOREIGN PATENT DOCUMENTS

| | | |
|---|---|---|
| 375 579 | 6/1990 | (EP) . |
| 1.164.203 | 10/1958 | (FR) . |

OTHER PUBLICATIONS

Web page—www.sunmates.com.
Web page—www.sunmates.com/retail.html.
Catalog sheet, item b, Lotion Applicator (SunMates): "As We Change" catalog, source code 0H811.
Product packaging (front and back) for Suncare Applicator.

* cited by examiner

*Primary Examiner*—Gregory L. Huson
*Assistant Examiner*—Kathleen J. Prunner
(74) *Attorney, Agent, or Firm*—Sheridan Ross P.C.

(57) ABSTRACT

A lotion applicator includes a flexible handle capable of being oriented in one of a plurality of positions. The handle is interconnected to a rigid plastic applicator head. The applicator head is provided with a plurality of indentations extending below an outer surface area of the applicator head. The indentations are capable of storing a predetermined volume of a viscous fluid.

20 Claims, 6 Drawing Sheets

42'
10'
50
70
14'

62
58
66

54
62
62

58
58
10'

50
78

APPARATUS FOR APPLYING A VISCOUS LOTION

CROSS-REFERENCE TO RELATED APPLICATIONS

This continuation-in-part application claims priority of pending U.S. application Ser. No. 09/444,046, filed Nov. 19, 1999, which claimed priority of U.S. Provisional Patent Application Serial No. 60/109,210, filed Nov. 20, 1998, the applications being incorporated herein by reference in their entirety.

FIELD OF THE INVENTION

The present invention relates to a method and apparatus for applying a hygiene product such as sun screen, moisturizing lotion and liquid soap to a person's body, especially to hard to reach portions of the body.

BACKGROUND OF THE INVENTION

Self application of a lotion to hard to reach body parts, such as a person's back, can be difficult without the assistance of another person or a mechanical apparatus. As used in this invention, the term "lotion" refers to any liquid preparation, for example, a compound or composition for cosmetic or external medicinal use including a prophylactic. Exemplary lotions include, but are not limited to, moisturizing lotions; suntan lotions; skin conditioners; anti-itching medicines, such as by drocortisone containing creams; calamine lotions; shampoo; liquid soaps; bair conditioners; and the like. Typical mechanical apparatus require application of the lotion onto the apparatus prior to applying the lotion to one's body. Moreover, many apparatus are rigid, thus making it difficult to conform to various shapes which may be required for application of lotion to different parts of the body. In addition, the rigid structure of these apparatus make them cumbersome to carry, especially during a recreational activity such as bicycling, hiking, jogging and skiing.

Therefore, there is a need for lotion applicator which can be adapted to a various configuration to allow application of lotion to various parts of a person's body. There is also a need for an applicator which is easy to carry and which can be removably interconnected to a variety of objects with numerous shapes.

SUMMARY OF THE INVENTION

It is thus an object of the present invention to provide a lotion applicator apparatus which includes an applicator, a means for retaining a shape memory and extended length for reaching hard to reach portions of the body, and a method of use thereof.

In one embodiment ofthe present invention, the lotion applicator apparatus comprises an applicator, a lotion housing operatively interconnected to the applicator, a pump device operatively interconnected to the lotion housing for applying lotion to the applicator, and a conduit interconnecting the lotion housing and the pump device. The conduit includes a means for retaining a shape memory. Preferably, the applicator is located within the lotion housing.

In another embodiment of the present invention, the lotion applicator apparatus comprises an applicator extension, which includes a grip portion, an applicator and a means for retaining a shape memory. Preferably, the applicator is removably interconnected to the applicator extension.

Yet in another embodiment of the present invention, the lotion applicator apparatus includes an applicator, a tubing interconnected to the applicator, and a means for connecting the tubing to a container, wherein the means for connecting the tubing to a container is located distal to the applicator. The tubing is flexible but has a shape memory for maintaining a new shape when it is bent and/or twisted.

It is a further object of the present invention to provide an impermeable applicator head which will not collect sand or other foreign objects, and is thus not susceptible of becoming contaminated like sponge type applicator heads or other permeable products. Thus in one aspect of the present invention an applicator head is provided which is made of a plastic type material such as polyethylene, nylon or other similar materials.

It is yet another object of the present invention to provide an applicator head which is washable, yet also has an integral storage mechanism. Thus, in one aspect of the present invention an applicator head is provided which has a plurality of indentations extending below the surface of the applicator head. These indentations may be a variety of shapes and sizes, but most preferably are round with a diameter of approximately 0.15 inches and with a depth of approximately 0.05 inches. These depressions have a storage volume in addition to creating a surface tension for holding viscous fluids in contact with the applicator head, even when the applicator head is in an inverted or tilted position. In an alternative embodiment, the indentations may have a triangular, square, or rectangular shape. Preferably, the outer surface of the applicator has a rounded, arcuate shape with the interior most portion of the applicator head having a greater thickness than the circumference of the applicator head. This design helps create the surface tension which allows the applicator head to return a given volume of viscous lotion.

It is yet another object of the present invention to provide an applicator head which can be washed in a typical dishwasher repeatedly without damaging the application head. Thus, the applicator head must be constructed of a durable material which will not deteriorate or otherwise fail at high temperatures. Thus, as stated above the applicator head is generally comprised of a rigid plastic material such as polyethylene or other similar materials commonly known in the art. Thus, in one aspect of the present invention, the following lotion applicator is provided:

A flexible lotion applicator capable of storing a predetermined volume of a viscous fluid on an impermeable applicator head, comprising:

a flexible handle having a first end, a second end and a memory which allows said handle to be placed in a plurality of operable positions; and said impermeable applicator head operably interconnected to said second end of said flexible handle and having a plurality of indentations extending below an outer surface of said rigid applicator head, which permits a predetermined volume of said viscous fluid to be selectively stored in said indentations until said applicator head is rubbed against a user's skin.

DETAILED DESCRIPTION OF THE INVENTION

Figure 1:
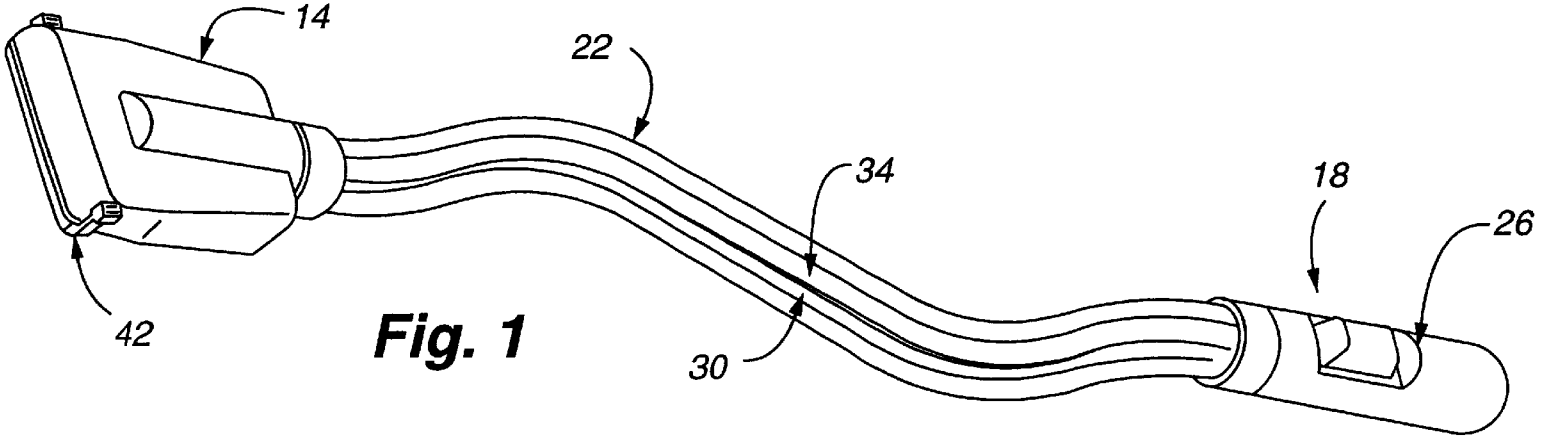
FIG. 1 is a top perspective view of one embodiment of the lotion applicator apparatus of the present invention.

The present invention will be described with regard to the accompanying drawings which assist in illustrating various features of the invention. In this regard, the present invention generally relates to an apparatus for applying a lotion to various parts of a person's body and a method of use thereof Specifically, the lotion applicator apparatus ofthe present invention is flexible to allow adaptation of various shapes; however, it retains its shape unless a sufficient external force is applied to change the shape. As used in this invention, the term "flexible" refers to the ability of the element to be bent or twisted. In this manner, the lotion maybe applied directly, i.e., without first having to dispense the lotion onto one's hand, on the desired body portion, i.e., it allows a "greaseless" application of the lotion.

By having a means for retaining the shape memory when bent and/or twisted, the apparatus of the present invention can be carried easily, for example, by wrapping it around one's arms, shoulders, neck, legs or the waist. In addition, the lotion application apparatus of the present invention can be carried by wrapping it around a recreational apparatus such as bicycles, rackets (including tennis rackets, squash rackets and racquetball rackets), golf bags, golf carts, baseball or softball bats and gloves, fishing gears, and other sports equipments.

The lotion applicator apparatus of the present invention can also be covered with water proof material to prevent diluting the material within the container when it is accidentally dropped into water or with a protective cloth covering.

One particular embodiment ofthe lotion applicator apparatus ofthe present invention is generally illustrated in FIGS. 1–5. It should be appreciated that in all cases Figures are provided for the purpose of illustrating a particular embodiment of the present invention and do not constitute limitations on the scope thereof.

As shown in FIGS. 1–5, one particular lotion applicator apparatus of the present invention includes an applicator 10 and a lotion housing 14. Preferably, the applicator 10 is a roller which is in a fluid communication with the lotion housing 14. More preferably, the applicator 10 is located within the lotion housing 14. The applicator 10 includes a means for applying a lotion onto a person's body. Such means can include any device which allows transfer of the lotion from the applicator 10 to the person's body. Exemplary devices for the applicator 10 include rollers, pads, sponges and any other device which may absorb or transfer lotion from the lotion housing 14 to the person's body. Alternatively, the applicator 10 can be made from a porous material such as a sponge, and other foam like materials. Other materials which may be used include fabrics, rubber, plastic, vinyl, wood, stainless steel, brass, aluminum, or polymers such as polyethylene, polyvinyl chloride, tetrafluoroethylene (e.g., Teflon®), polypropylene, and combinations thereof.

The lotion applicator apparatus shown in FIGS. 1–5 may also include a pump device 18, preferably a manual pump, and a conduit 22, which is interconnected to the pump device 18 and the lotion housing 14. The pump device 18 pushes the lotion from the lotion housing 14 onto the applicator 10. Preferably, the pump device is an air pump. In this manner, air is pumped through the conduit 22 causing the lotion in the lotion housing 14 to contact the applicator 10. Specifically, squeezing the pump device 18 forces air into the lotion housing 14, thereby pushing the lotion upward onto the applicator 10. The lotion is then applied to a person's body by contacting the applicator to a desired portion of the person's body. In one particular embodiment, the pump device 18 is operated by applying a pressure or a force, e.g., by squeezing or pushing a pump button 26.

The pump device 18 can also include a check valve 28. The check valve 28, i.e., a one-way valve, can be any valve system which allows flow of a fluid in one direction. Thus, in the pump device 18, the check valve 28 allows the flow of air only into the conduit 22 but does not allow the air to flow backward from the conduit 22 to the pump device 18. In this manner, when the pump button 26 is pushed, the air in the conduit 22 is pushed (i.e., forced) into the lotion housing 14. When the button 26 is released, the check valve allows the air to enter into the conduit 22 to re-establish equilibrium of pressure between the conduit 22 and the atmosphere.

The conduit 22 allows the transfer of the lotion to the applicator 10 which is then applied onto a person's body. The length of the conduit 22 should be sufficiently long enough to allow application of a lotion to various parts of a person's body. Preferably the conduit 22 is from about 5 inches to about 20 inches, more preferably from about 7 inches to about 18 inches, and most preferably from about 10 inches to about 15 inches. Alternatively, the conduit 22 can be a telescoping conduit to allow adjustment of its length depending on its use.

The conduit 22 of the present invention is preferably flexible. The flexibility of the conduit 22 maybe due to the inherent nature of the conduit material, by the presence of one or more connections within the conduit 22, or combinations thereof. Any type of connection which allows the overall shape of the conduit 22 to be changed can be used to provide a flexibility of the conduit 22.

Figure 2:
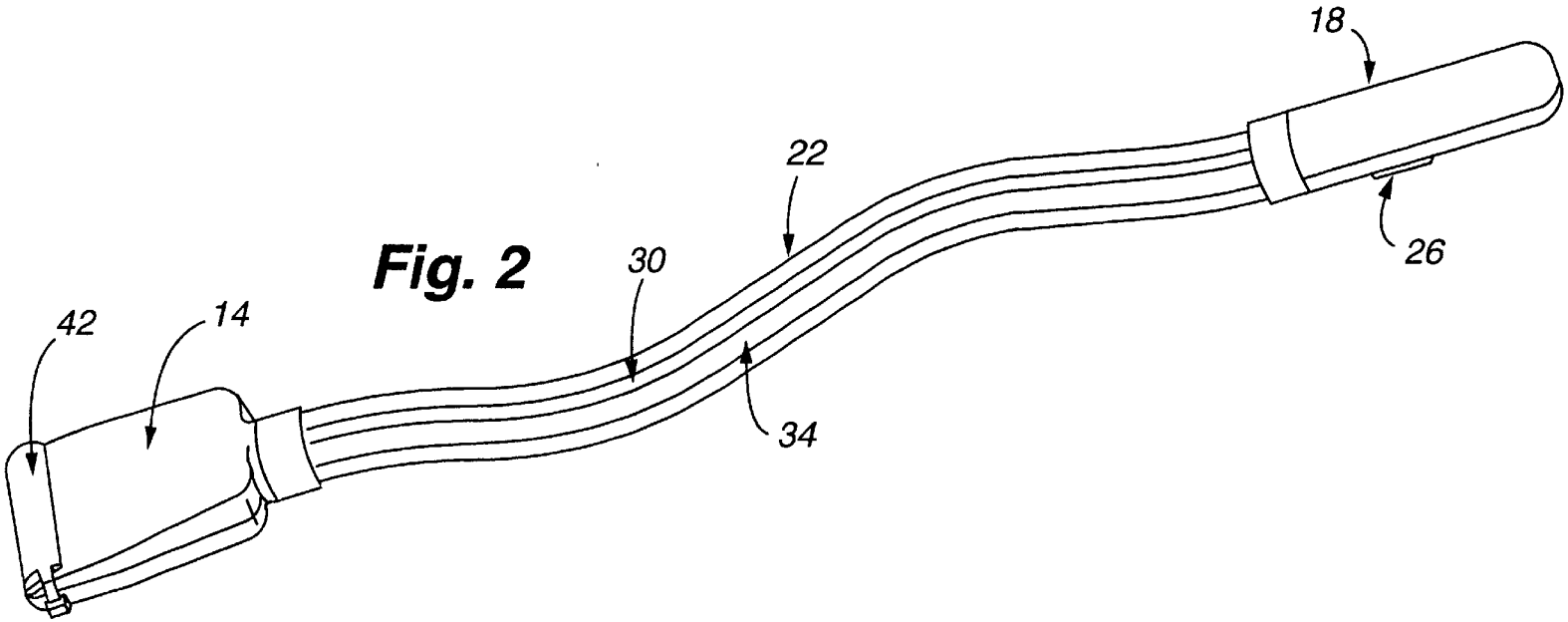
FIG. 2 is a bottom perspective view of one embodiment of the lotion applicator apparatus of the present invention.
Figures 3, 4:
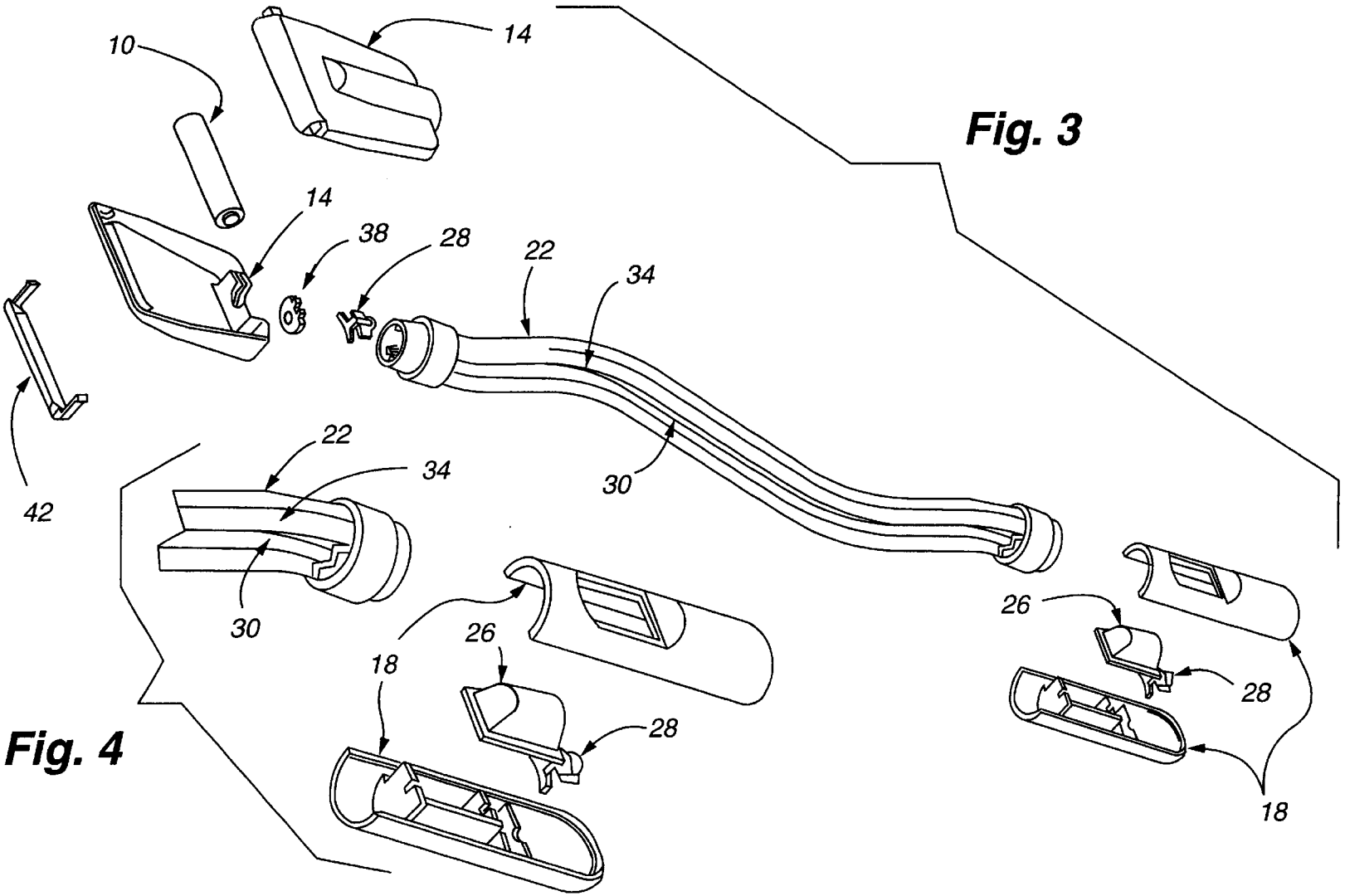
FIG. 3 is a top perspective view of one embodiment of the lotion applicator apparatus of the present invention showing various parts in a detached form.
FIG. 4 is an exploded view of one embodiment of a pump device for the lotion applicator apparatus of the present invention.
Figure 5:
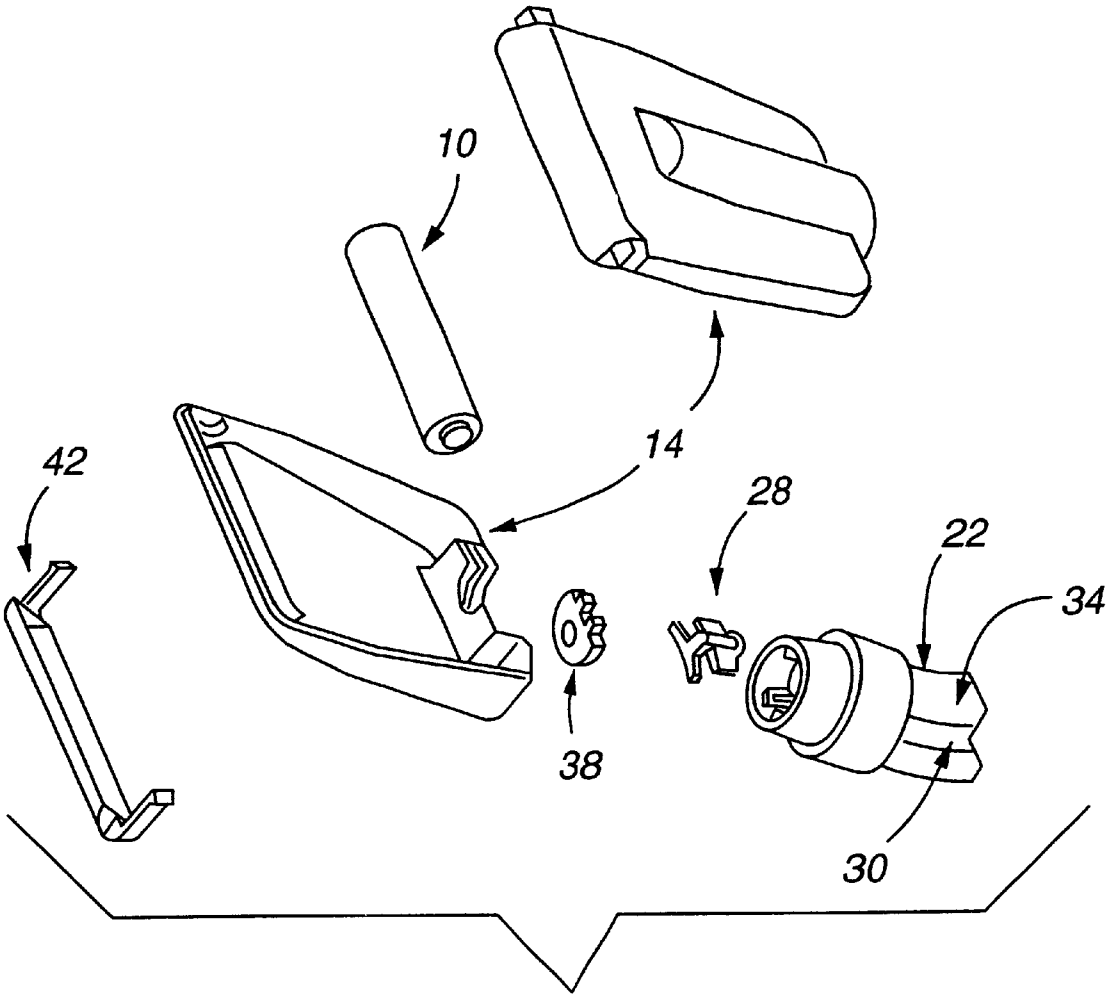
FIG. 5 is an exploded view of one embodiment of a lotion housing for the lotion applicator apparatus of the present invention.

The conduit 22 of the present invention includes a means for retaining a particular shape, i.e., the conduit 22 has shape memory. Such means can include any device which allows the conduit 22 to retain its new shape after it is twisted and/or bent. Exemplary shape retaining devices include a wire, one or more of ball and socket type ofjoints displaced along the length of the conduit, plastic, rubber, a polymer, combinations thereof, and the like. When a wire 30 is used to maintain the shape of the conduit 22, the wire 30 may be embedded within the conduit 22, wrapped around the conduit 22, attached to the conduit 22, or, as shown in FIGS. 1–3, placed inside the conduit 22. A particular material and the diameter of the wire 22 used depends on the conduit material. In general, the wire 30 should provide a sufficient strength to maintain the shape of the conduit, and yet should provide a relatively easy manipulation of the conduit 22 to allow the shape of the conduit 22 to be changed easily. In one particular embodiment of the present invention, the conduit 22 includes the wire 30 having a diameter of from about 1/16 inch to about 3/8 inch to provide the conduit 22 with a shape memory. Preferably, the diameter of the wire 30 is from about 1/8 inch to about 1/4 inches, and more preferably about 1/8 inch.

The conduit 22 can also includes a tubing 34, which is interconnected to the pump device 18 for forcing air into the lotion housing 14 when the pump button 26 is pushed. The tubing 34 can be made from any material which does not decompose or react with the lotion being used. Exemplary materials which are useful for a tubing include polyethylene, rubber, polyvinyl chloride, polymer of tetrafluoroethylene (e.g., Teflon®), and combinations thereof. The inner diameter of the tubing 34 should be sufficiently large enough to allow the sufficient amount of air to be pumped into the lotion housing 14 without requiring too much pressure. Preferably the inner diameter of the tubing 34 is from about 1/16 inch to about 3/4 inch, more preferably from about 1/8 inch to about 1/2 inch, still more preferably from about 3/16 inch to about 5/8 inch, and most preferably about 1/4 inch.

The interconnection between the conduit 22 and the lotion housing 14 can include a means for disconnecting the lotion housing 14 from the conduit 22 for cleaning, replacing components or other purposes. Such means include any device which allows disconnection of the lotion housing 14 from the conduit 22. Exemplary disconnecting devices include a screw and thread mechanism, pin and socket mechanism, a corresponding cam-lock mechanism, and other similar devices. Similarly, the apparatus of the present invention can also include an interconnection between the conduit 22 and the pump device 18 for allowing disconnection ofthe pump device 18 from the conduit 22. In one particular embodiment, the disconnecting device in both cases is a cam-lock mechanism.

The interconnection between the conduit 22 and the lotion housing 14 can also include a check valve 28, which is described in detail above. The check valve 28 in the lotion housing 14 allows the flow of air into the lotion housing 14 and prevents the flow of lotion from the lotion housing 14 to the conduit 22. In this manner, when the pump button 26 is pushed, the air in the conduit 22 is pushed into the lotion housing 14 which causes the lotion to move toward and be transferred to the applicator 10. When the button 26 is released, the check valve 28 in the lotion housing 14 prevents the lotion from flowing into the conduit 22. The lotion housing 14 can also include a device, such as a clip 38, which holds the check valve 28 in the lotion housing 14 in place. Alternatively, the lotion housing 14 and/or the pump device 18 can be configured such that the corresponding check valve 28 remains stationary during use.

The lotion applicator apparatus of the present invention can also include a cover 42, e.g., a cap, for covering the applicator 10. The cover prevents or retards the lotion on the applicator 10 from caking, i.e., solidifying. The cover 42 can be removably attached or it can be attached via a hinge to the lotion housing 14 so that it can be moved up or down, thereby exposing the applicator 10 when needed.

The interconnection of the lotion housing 14 and the conduit 22 can also include a means for allowing rotation of the lotion housing 14 relative to the conduit 22. Such means include any rotational device which allows the lotion housing 14 to be rotated relative to the conduit 22. Exemplary rotational devices include an elbow joint, a ball and socketjoint, and the like.

Another embodiment of the present invention is shown in FIGS. 6–9. In this embodiment, the lotion applicator comprises an applicator 10' and an applicator extension 50. Preferably, the applicator 10' is removably interconnected to the applicator extension 50, for example, via an applicator housing 54. The applicator 10' and the applicator housing 54 can include corresponding interconnection mechanisms 58 and 62 which allow the applicator 10' to be removably interconnected to the applicator housing 54. Exemplary interconnection mechanisms include any device which allows ease of removal and attachment such as a notch or an opening and a corresponding flexible clip or a button, as shown in FIG. 7C; hook and loop (e.g., Velcro®); an interlocking cam-lock; a nut and bolt mechanism; a snap-on button; an elastic loop (e.g., rubber band) which can be placed around the applicator housing 54; a button with a corresponding button hole; and a screw and thread mechanism.

The applicator 10' maybe any of the type described above. Preferably, the applicator 10' of the lotion applicator shown on FIGS. 6–9 is removably interconnected to the applicator extension 50, thus allowing the lotion applicator to be fitted with a variety of applicator material or styles depending on its particular use. For example, when the lotion is an oil the applicator material will be typically less porous material such as cloth or a relatively dense foam, foam-rubber, sponge or sponge-like material, whereas when the lotion is gel-like the applicator material will generally be more porous foam, foam-rubber, sponge or sponge-like material.

Figures 6, 7A, 7B, 7C, 9:
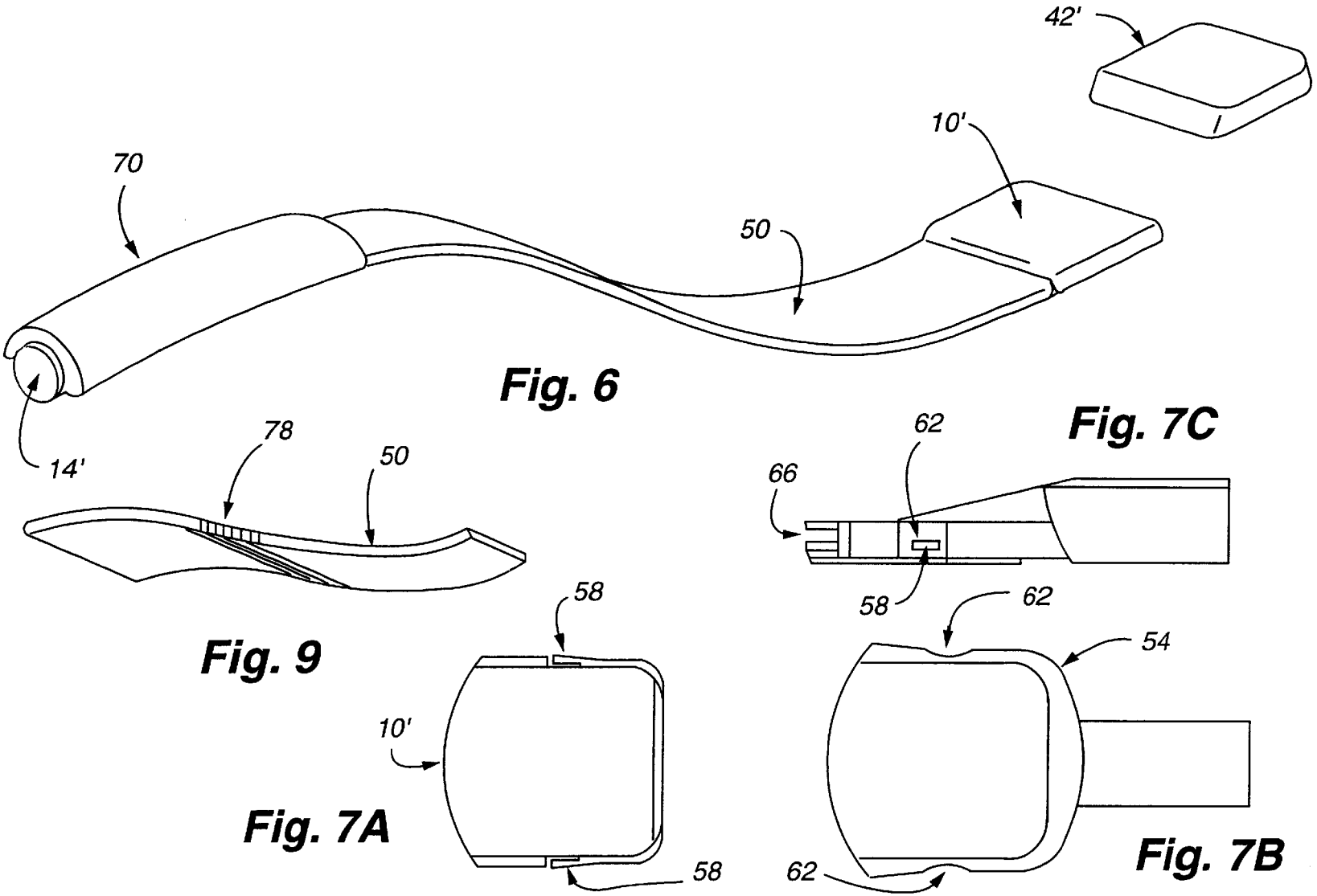
FIG. 6 is a perspective view of another embodiment of the lotion applicator apparatus of the present invention which is made of a malleable material to provide a means for retaining a shape memory.
FIG. 7A is a top view of a removable applicator which is detached from the lotion applicator apparatus of FIG. 6.
FIG. 7B is a top view of a corresponding applicator housing.
FIG. 7C is a side view of the lotion applicator of FIG. 6 with the applicator removably attached to the applicator housing.
FIG. 9 is a cut-out view of an alternative hinge member.

As shown in FIG. 7C, the applicator housing 54 can further comprise a compartment 66 for storing an additional or extra applicator 10'. In this manner, applicators for both oil and gel-like lotions can be present in a single lotion applicator unit. In addition, as described above the lotion applicator can also include a cover 42' which is used to cover the applicator 10' when not in use.

The applicator extension 50 can also include a grip portion 70, which may comprise a lotion housing 14', which is preferably removably attached. Preferably, the grip portion 70 comprises a relatively deformable material to provide a soft gripping. Exemplary deformable materials include rubber, foam, relatively soft plastic and the like. While the lotion housing 14' may be in fluid communication with the applicator 10' as described above, in this particular embodiment the lotion housing 14' is typically not in a fluid communication with the applicator 10'. But rather, the lotion housing 14' is used primarily as a storage device for lotion. The lotion housing 14' typically comprises a tube which can be removably attached to the applicator extension 50, for example, by a snap-on, cam-lock device, screw and thread, tie-on, hook-and-loop and other similar mechanisms.

Similar to the conduit 22 described above, the applicator extension 50 comprises a means for retaining a shape memory. In addition to the shape memory retaining means described above, other shape memory retaining means include a hinge (74 in FIG. 8) and multiple hinge means (78 in FIG. 9) within the applicator extension. Preferably, the applicator extension itself is made from a malleable material which can be readily bent or twisted by hand, yet strong enough to substantially retain its shape when applying a lotion to a body. Exemplary malleable materials include metals, such as aluminum, copper, nickel, magnesium, zinc, iron, silver, gold, tin and mixtures thereof; and polymers.

Figure 8:
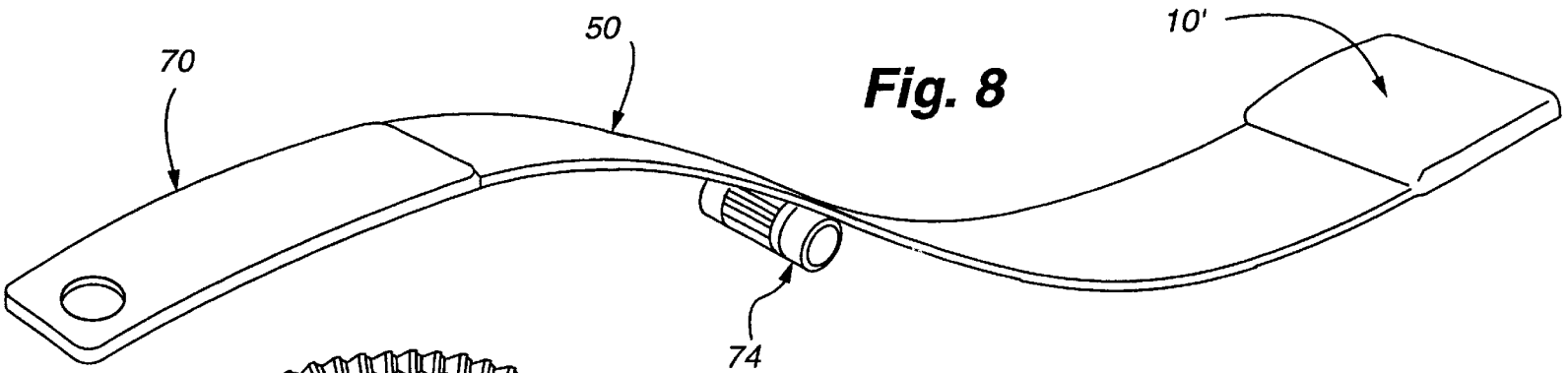
FIG. 8 is a perspective view of still another lotion applicator apparatus of the present invention having a hinge member.

The applicator extension 50 can be a variety of shapes such as cylindrical, rectangular, triangular, hexagonal, and octagonal tubes, or preferably a relatively flat shape as those exemplified in FIGS. 6 and 8.

The applicator extension 50 can further comprise a covering such as cloth, foam, rubber, plastic or mixtures thereof. The covering may serve to protect the actual applicator extension material and/or decorative purposes.

A method of using the lotion applicator apparatus embodied in FIGS. 6–9 typically is as follows: the lotion is applied to the applicator 10', and the lotion is then applied to a person's body by contacting the applicator 10' to a desired portion of the persons body. The shape of the applicator extension 50 may be adjusted depending on a particular part of the body the lotion is being applied to.

Figure 10B:
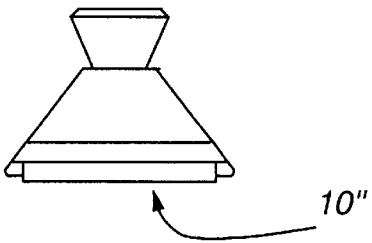
FIG. 10B is an enlarged view of the applicator portion of the embodiment of FIG. 10A.
Figure 10A:
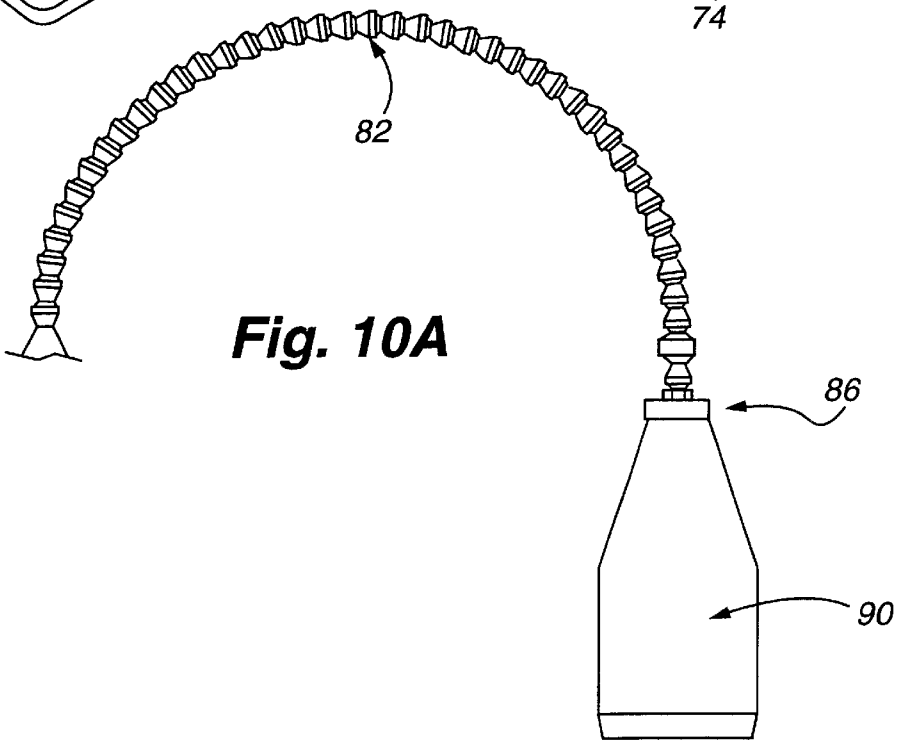
FIG. 10A is a perspective view of yet another embodiment of the lotion applicator apparatus of the present invention showing the tubing that is connected to a lotion container but is detached from the applicator.
Figure 13:
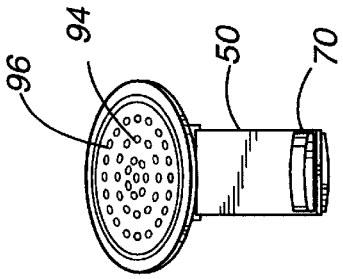
FIG. 13 is an upper end view of the invention shown in FIG. 11.
Figure 12:
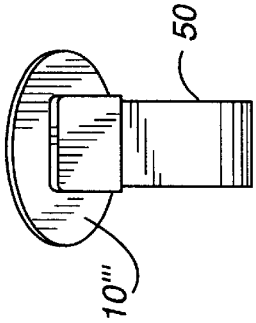
FIG. 12 is a lower end view of the invention shown in FIG. 11.
Figure 11:
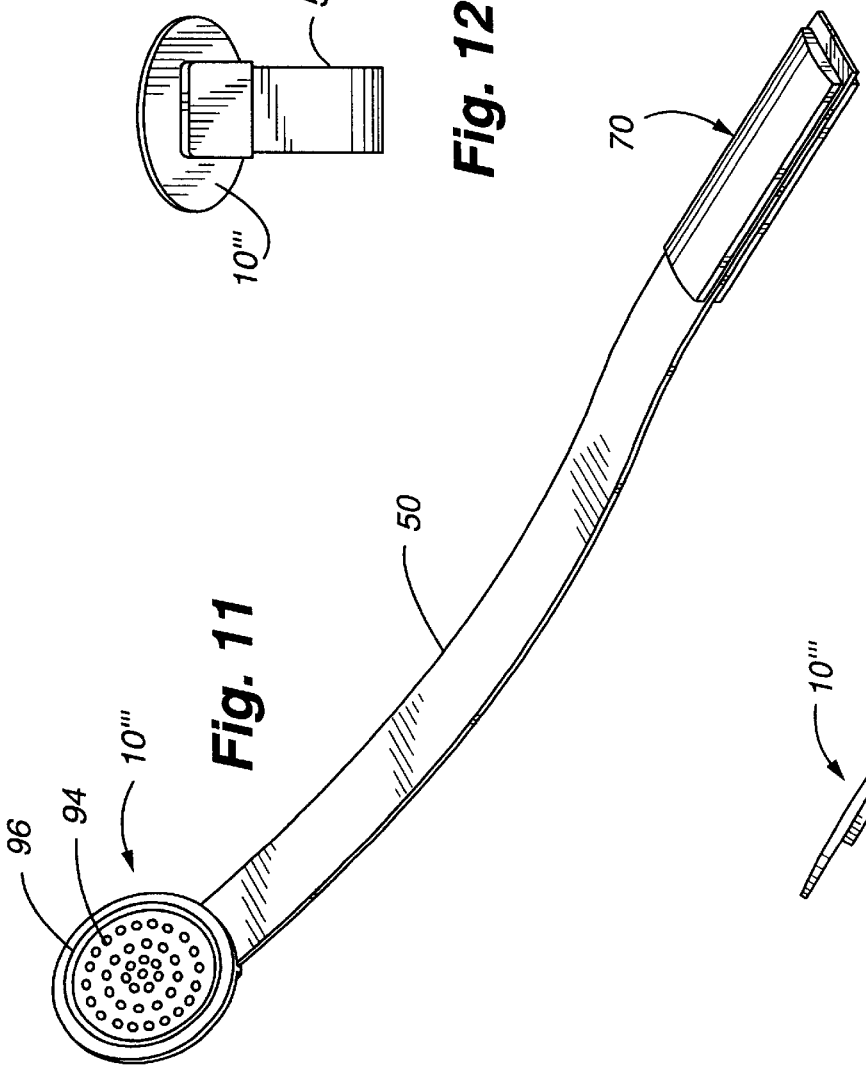
FIG. 11 is a front perspective view of an alternative embodiment of the present invention and showing a non-permeable head with a plurality of indentations extending below the surface of the non-permeable head.
Figure 14:
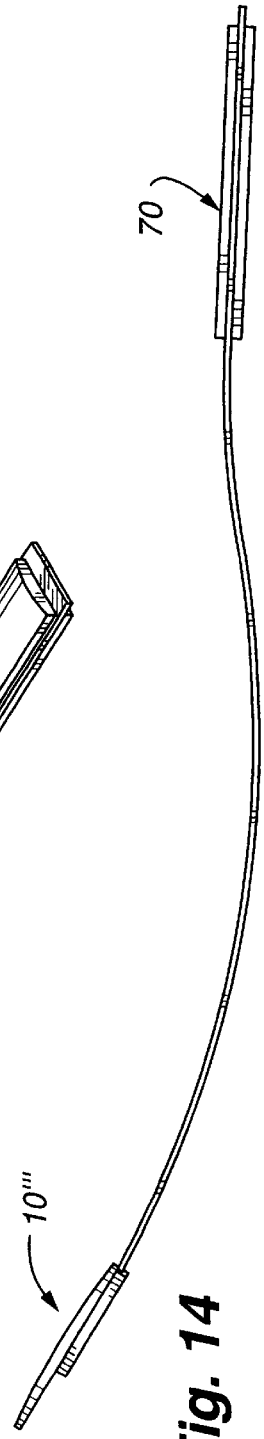
FIG. 14 is a front elevation view of the invention shown in FIG. 11.

Still another embodiment of the lotion applicator of the present invention is illustrated in FIG. 10. In this embodiment, the lotion applicator apparatus includes an applicator 10", such as those described above. The lotion applicator apparatus of FIG. 10 can also include a tubing 82 interconnected to the applicator. The tubing 82 allows the transfer of the lotion to the applicator 10" which is then applied onto a person's body. The tubing 82 can be made from any material which does not decompose or react with the lotion being used. Exemplary materials which are useful for a tubing include polyethylene, rubber, polyvinyl chloride, polymer of tetrafluoroethylene (e.g., Teflon®), and combinations thereof.

The inner diameter of the tubing 82 should be sufficiently large enough to allow the lotion to be transferred to the applicator without requiring too much pressure. Preferably the inner diameter of the tubing 82 is from about 1/16 inch to about 3/4 inch, more preferably from about 1/8 inch to about 1/2 inch, still more preferably from about 3/16 inch to about 5/8 inch, and most preferably about 1/4 inch. It should be appreciated, however, that the actual diameter of the tubing 82 may depend on the viscosity of the lotion being used. The length of the tubing 82 should be sufficiently long enough to allow application of lotion to various parts of a person's body. Preferably the tubing 82 is from about 5 inches to about 20 inches, more preferably from about 7 inches to about 18 inches, and most preferably from about 10 inches to about 15 inches. Alternatively, the tubing 82 can be a telescoping tubing to allow adjustment of its length depending on its use.

The tubing 82 of the present invention is preferably flexible. The flexibility of the tubing 82 may be due to any of the above described reasons including the inherent nature of the tubing material, by the presence of one or more connections within the tubing 82, or combinations thereof. Any type of connection which allows the overall shape of the tubing 82 to be changed can be used to provide a flexibility of the tubing 82. Preferably, the connection is a ball and socket joint or the like.

Similar to the conduit 22 described above in reference to FIGS. 1–5, the tubing 82 of FIG. 10 includes a means for retaining a particular shape, i.e., the tubing has a shape memory. In a particular embodiment of the lotion applicator shown in FIG. 10, a wire having a diameter of from about 1/16 inch to about 3/8 inch is attached to the tubing 82 to provide the tubing 82 with a shape memory. Preferably, the diameter of the wire is from about 1/8 inch to about 1/4 inches, and more preferably from about 1/8 inch.

The interconnection between the tubing 82 and the applicator 10" can include a means for disconnecting the applicator 10" from the tubing 82 for allowing detachment of the applicator 10" from the tubing material for cleaning or replacing the applicator, or other purposes. Such means include any device which allows disconnection of the applicator 10 from the tubing 82. Exemplary disconnecting devices include screw and thread mechanism, pin and socket mechanism, and other similar devices.

The interconnection of the applicator 10" and the tubing 82 can also include a means for allowing rotation of the applicator relative to the tubing 82. Such means include any rotational device which allows the applicator 10" to be rotated relative to the tubing 82. Exemplary rotational devices include an elbow joint, a ball and socket joint, and the like.

The lotion applicator apparatus of FIG. 10 can also include a connection joint 86 interconnected to the tubing 82 and located distal to the applicator 10". The connection joint 86 allows the lotion applicator to be attached to a container 90 which contains the lotion. The connection joint 86 can be a screw on type of cap, or other similar material which allows attachment of the tubing 82 onto a container 90 which contains the lotion.

The container 90 which the lotion applicator apparatus of FIG. 10 connects to may be the lotion's original container, i.e., the container in which the lotion is sold in, or a separate container can be provided which can be attached to the lotion applicator apparatus. In either case, a means for allowing the lotion drawn into the tubing 82 to return to the container is provided. Such means include any return flow device which allows the lotion to return to the container by gravity when no other external force or pressure is applied. Exemplary return flow devices include a check valve (not shown), and the like. A check valve can be any valve system which allows flow of air in one direction. A check valve allows the air to enter into the container but does not allow the air to escape through it. In this manner, when the lotion container 90 is squeezed, the lotion flows into and through the tubing 82. When the squeezing or other similar pressure is removed from the container 90, the check valve allows the air to enter into the container 90 to establish equilibrium of pressure between the container and the atmosphere. This pressure equilibrium allows the lotion in the tubing 82 to flow back into the container 90. A check valve allows the air to enter into the container 90 to allow the liquid contained within the tubing 82 to be returned properly into the container 90 itself by gravity when no other external force is present. A return flow device (not shown) can be present on the connection joint or the container 90 to which the lotion applicator apparatus of FIG. 10 is attached. Preferably, the return flow device is present on the lotion container 90.

In general, a lotion is dispensed from the container 90 by squeezing the container 90 which is attached to the lotion applicator apparatus of FIG. 10 through the connection joint 86. Squeezing the container 90 forces the lotion to enter into the tubing 82 and ultimately onto the applicator 10". The lotion is then applied to a person's body by contacting the applicator 10" to a desired portion of the person's body. The container 90 should be flexible so that it can be squeezed relatively easily. When the pressure on the container 90 is released, e.g., squeezing is discontinued, the lotion contained within the tubing 82 flows back into the container 90 by gravity.

Referring now to FIGS. 11–14 an alternative embodiment of the present invention is provided wherein a non-permeable applicator head 10'" is provided. The applicator head 10'" generally has a plurality of indentations 94 extending below the outer surface of the applicator head 10'" which are used to store a small volume of viscous lotion. More importantly, due to the size and shape of the indentations 94, a surface tension is created which holds the viscous lotion substantially in place, even when the applicator head is tilted or inverted. Further, the outer surface of the applicator head has an arcuate, rounded shape which has an incline from the inner most portion of the applicator head to the outer most portion. This accurate outer surface in combination with the plurality of indentations allows a predetermined volume of a viscous sunscreen or other types of lotion to be applied to the applicator head 10'" without the sunscreen dripping from the application head 10'", even in an inclined or inverted position.

Preferably the indentations 94 are circular in shape and have a diameter of between about 0.10 inches and 0.25 inches and preferably about 0.015 inches. The depth of the indentations 94 may vary significantly, but are generally between about 0.025 and 0.20 inches, and preferably about 0.054 inches.

The circular ring 96 which extends around the perimeter of the applicator head generally has a "V" cross-sectional shape with a depth substantially the same as the depth of the indentations 94. The width of the circular ring 96 may vary considerably, but is preferably about 0.05 inches and 0.20 inches. Of course, different cross-sectional shape configurations of the circular ring 96, for example square or semi-circular, could be used to accomplish the same purpose of storing and retaining the viscous lotion until use.

The applicator head is generally comprised of commonly known impermeable materials such as plastic, and variations therein. For example, polyethylene, polypropylene, nylon, teflon and other similar materials can be used. However, it is preferred that the material be durable enough to withstand high temperatures, such as those commonly found in typical dishwashers, i.e., 100° F.–250° F. Preferably the applicator head 10'" may be removably interconnected to the applicator extension 50 to allow removal for cleaning as necessary.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein above are further intended to explain best modes known for practicing the invention and to enable others skilled in the art to utilize the invention in such, or other, embodiments and with various modifications required by the particular applications or uses ofthe present invention. It is intended that the appended claims be construed to include alternative embodiments to the extent permitted by the prior art.

What is claimed is:

1. A flexible lotion applicator capable of storing a predetermined volume of a viscous fluid on an impermeable rigid applicator head, comprising:

a flexible handle having a first end, a second end and a memory which allows said handle to be placed in a plurality of operable positions; and said impermeable applicator head being operably interconnected to said second end of said flexible handle and having a plurality of indentations extending below an outer surface of said rigid applicator head, which permits a predetermined volume of said viscous fluid to be selectively stored in said indentations until said applicator head is rubbed against a user's skin.

2. The lotion applicator of claim 1, wherein said handle has a hinge positioned between said first end and said second end, wherein said handle can be folded.

3. The lotion applicator of claim 1, wherein said applicator head is pivotally interconnected to said second end of said applicator handle.

4. The lotion applicator of claim 1, wherein said applicator head is comprised of plastic.

5. The lotion applicator of claim 4, wherein said applicator head is comprised of polyethylene.

6. The lotion applicator of claim 1, wherein said plurality of indentations have a circular shape.

7. The lotion applicator of claim 1, wherein said flexible handle is comprised of a metallic material.

8. The lotion applicator of claim 7, wherein said flexible handle is comprised of aluminum.

9. The lotion applicator of claim 1, wherein said rigid applicator head is removably interconnected to said second end of said handle.

10. The lotion applicator of claim 1, wherein said plurality of indentations have a size and shape which create a surface tension on said outer surface of said applicator head.

11. An apparatus for applying a viscous lotion to a user's body, comprising:

a flexible handle having a first end and a second end;

an impermeable rigid plastic applicator head interconnected to said second end of said flexible handle and having a plurality of indentations extending inwardly from an outer surface of said applicator head, said plurality of indentations creating a surface tension adapted to allow a predetermined volume of said viscous fluid to be stored within said plurality of indentations and on said outer surface when said apparatus is in an inclined or inverted position.

12. The apparatus of claim 11, wherein said flexible handle has a hinge positioned between said first end and said second end, wherein said handle can be folded.

13. The apparatus of claim 12, wherein said flexible handle is comprised of plastic.

14. The apparatus of claim 11, wherein said plurality of indentations have a circular shape.

15. The apparatus of claim 11, wherein said rigid plastic applicator head is removably interconnected to said second end of said handle.

16. The apparatus of claim 11, wherein said rigid plastic applicator head is comprised of polyethylene.

17. The apparatus of claim 11, wherein said rigid plastic applicator head is machine washable.

18. The apparatus of claim 11, comprising at least one circular ring extending substantially around an outer circumference of said applicator head.

19. The apparatus of claim 11, wherein said plurality of indentations extend below said outer surface of said applicator head at least about 0.05 inches.

20. The apparatus of claim 11, wherein said outer surface of said applicator head has an arcuate shape.

* * * * *